United States Patent [19]

Manno

[11] Patent Number: 4,688,926

[45] Date of Patent: Aug. 25, 1987

[54] TONER SUPPLY CARTRIDGE AND DISPENSING SYSTEM FOR REPRODUCTION AND PRINTING MACHINES

[75] Inventor: Eugene J. Manno, Ontario, N.Y.

[73] Assignee: Xerox Corporation, Stamford, Conn.

[21] Appl. No.: 818,928

[22] Filed: Jan. 15, 1986

[51] Int. Cl.[4] ..... G03G 15/08

[52] U.S. Cl. ..... 355/3 DD; 118/653; 222/DIG. 1

[58] Field of Search ..... 355/3 DD; 118/653–658, 118/689–691; 222/DIG. 1

[56] References Cited

U.S. PATENT DOCUMENTS

| | | | |
|---|---|---|---|
| 2,965,266 | 12/1960 | Rutkus, Jr. et al. | 222/70 |
| 3,337,072 | 8/1967 | Del Vecchio | 214/304 |
| 3,339,807 | 9/1967 | Eichorn | 222/171 |
| 3,722,471 | 3/1973 | Stoeffel et al. | 222/DIG. 1 |
| 4,089,601 | 5/1978 | Navone | 355/14 |
| 4,091,765 | 5/1978 | Lowthorp et al. | 118/658 |
| 4,349,132 | 9/1982 | Macaluso et al. | 222/DIG. 1 |
| 4,391,503 | 7/1983 | Pugh | 355/3 DD |
| 4,478,512 | 10/1984 | Zoltner | 222/DIG. 1 |
| 4,611,899 | 9/1986 | Kasamura et al. | 355/3 DD |

*Primary Examiner*—R. L. Moses

*Attorney, Agent, or Firm*—Frederick E. McMullen

[57] ABSTRACT

A reproduction machine having a rotatable toner supply cartridge, a row of toner discharge ports in the cartridge, a toner ejecting rod with flats opposite each port, and a cam drive for quickly rotating the rod to temporarily causing the flats to face outwardly into the machine developer housing so as to dump the controlled amount of toner on the each flat into the developer housing.

In an alternate embodiment, the ejecting rod is replaced by a reciprocable slide plate having row of openings which match with the toner discharge ports, and a cam drive for temporarily moving the plate to match the plate openings with the toner discharge ports and discharge a controlled amount of toner into the developer housing.

13 Claims, 10 Drawing Figures

TONER SUPPLY CARTRIDGE AND DISPENSING SYSTEM FOR REPRODUCTION AND PRINTING MACHINES

The invention relates to reproduction machines, and more particularly, to an improved system for supplying fresh or makeup toner to reproduction machines.

In xerographic type reproduction machines, latent electrostatic images of the item being copied or printed are generated on a moving recording member such as a photoreceptor through exposure to the document being copied or in accordance with an image signal input. Prior to exposure, the recording member is first readied as by charging. Following exposure, the latent electrostatic images on the recording member are developed at a developing station which in typical present day practice, comprises one or more magnetic brushes for bringing a developer, usually a mixture of carrier beads and toner, into developing relation with the recording membe and the image thereon. Following this, the developed image is transfered at a transfer station to a copy substrate material such as a sheet of paper. After transfer, leftover developer is removed from the recording member while the developed image previously transferred to the copy substrate material is fixed as by fusing to provide a permanent copy or reproduction.

In the course of developing images as described above, the toner portion of the developer mixture is depleted and to maintain the necessary proportion of toner, fresh toner must be added from time to time. And since machines of this type are normally capable of processing several difference size images up to a preset maximum, toner depletion may not be uniform across the width of the developer sump.

Various types of toner re-supply systems are known to prior art as for example the canister or cartridge type shown by U.S. Pat. Nos. 3,337,072 (Del Vecchio et al) and 4,091,765 (Lowthorp et al). In the Del Vecchio et al and Lowthorp et al prior art arrangements, a toner supply canister consisting of relatively rotatable inner and outer concentric tubes, each with a toner dispensing opening are used. The supply of fresh toner is held in the inner tube, and by rotating the inner tube relative to the outer tube, the toner dispensing openings in each are brought in alignment. Another system is shown by U.S. Pat. No. 3,339,807 (Eichorn). There, the toner supply canister, once mounted, rotates to bring the toner dispensing holes opposite a series of openings in a stationary grid. Preparatory to this, a tear away strip, which seals the holes during shipment is first removed. In another prior art system shown by U.S. Pat. No. 4,089,601 (Navone), the toner canister is shipped in a housing. The canister/housing assembly is installed in the machine following which the canister is turned to communicate the toner dispensing openings with the developer sump. And in U.S. Pat. No. 2,965,266 (Rutkus, Jr. et al), the canister is vertically oriented instead of horizontal.

In constrast to the above referenced prior art , the present invention provides a reproduction machine which comprises in combination: a movable recording member on which latent electrostatic images are created, developing means for developing the electrostatic images with toner; transfer means for transferring the developed images to a copy substrate material including a developer housing with sump adjacent the recording member and means to bring developer from the sump into developing relation with the recording member to develop images on the recording member; and a toner supply cartridge for supplying fresh toner to the developer housing including a tube-like cylinder adapted to contain a supply of fresh toner; means supporting the cylinder in the developer housing; drive means for rotating the cylinder, the cylinder having a plurality of toner discharge openings therein for toner to pass from the cylinder into the developer housing; and control means for discharging controlled amounts of fresh toner through the toner discharge openings once each revolution of the cylinder,the control means discharging toner while the toner discharge openings are facing inward of the developer housing so that toner discharged through the toner discharge openings falls into the developer housing.

IN THE DRAWINGS

Figure 1:
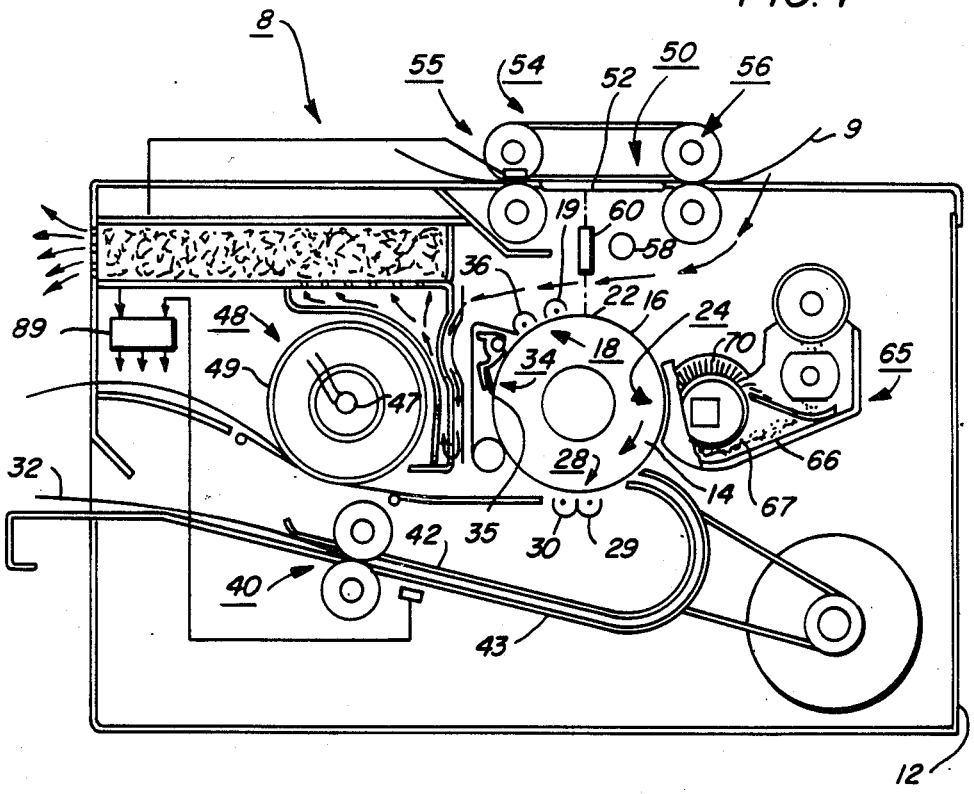
FIG. 1 is a side view in section of a reproduction machine incorporating the developer stripper plate and shroud of the present invention.

Referring to FIG. 1 of the drawings, there is shown a xerographic type reproduction machine 8 incorporating the toner supply cartridge, designated generally by the numeral 100, of the present invention. Machine 8 has a suitable frame 12 on which the machine xerographic components are operatively supported. Briefly, and as will be familiar to those skilled in the art, the machine xerographic components include a recording member, shown here in the form of a rotatable photoreceptor 14. In the exemplary arrangement shown, photoreceptor 14 comprises a drum having a photoconductive surface 16. Other photoreceptor types such as belt, web, etc. may instead be contemplated. Operatively disposed about the periphery of photoreceptor 14 are charge station 18 with charge corotron 19 for placing a uniform charge on the photoconductive surface 16 of photoreceptor 14, exposure station 22 where the previously charged photoconductive surface 16 is exposed to image rays of the document 9 being copied or reproduced, development station 24 where the latent electrostatic image created on photoconductive surface 16 is developed by toner, transfer station 28 with transfer corotrons 29, 30 for transferring the developed image to a suitable copy substrate material such as a copy sheet 32 brought forward in timed relation with the developed image on photoconductive surface 16, and cleaning station 34 with cleaning blade 35 and discharge corotron 36 for removing leftover developer from photoconductive surface 16 and neutralizing residual charges thereon.

Copy sheets 32 are brought forward to transfer station 28 by feed roll pair 40, sheet guides 42, 43 serving to guide the sheet through an approximately 180° turn prior to transfer station 28. Following transfer, the sheet 28 is carried forward to a fusing station 48 where the toner image is fixed by fusing roll 49. Fusing roll 49 is heated by a suitable heater such as lamp 47 disposed within the interior of roll 49. After fixing, the copy sheet 28 is discharged.

A transparent platen 50 supports the document 9 as the document is moved past a scan point 52 by a constant velocity type transport 54. As will be understood, scan point 52 is in effect a scan line extending across the width of platen 50 at a desired point along platen 50 where the document is scanned line by line as the document is moved along platen 50 by transport 54. Transport 54 has input and output document feed roll pairs 55,56 respectively on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

Figure 2:
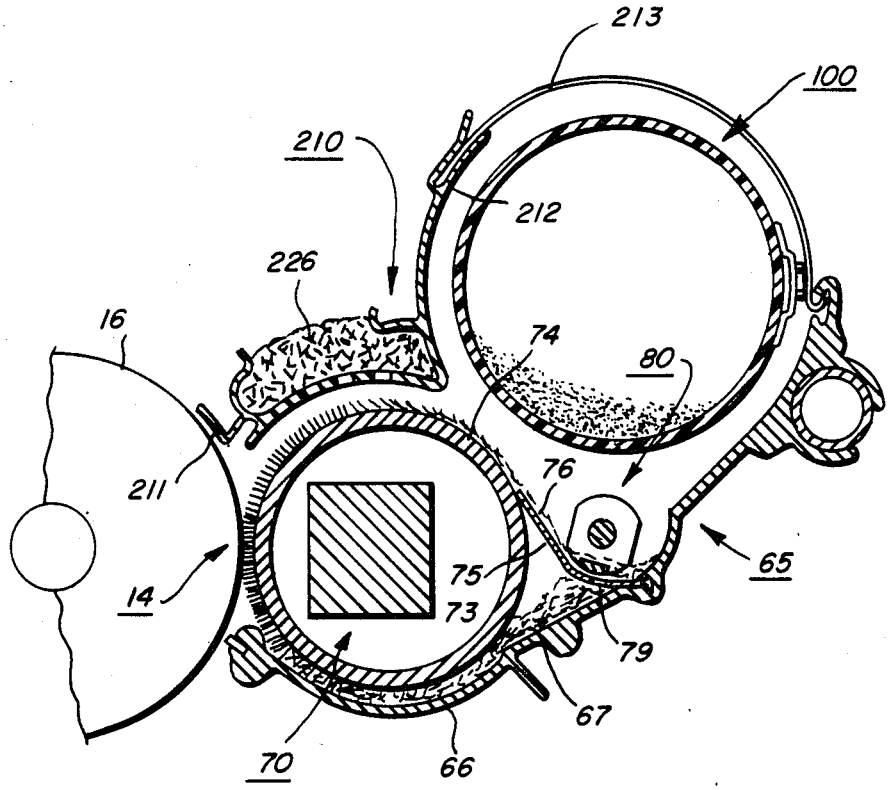
FIG. 2 is a side view in section showing the machine developer section including the magnetic developer roll, stripper plate, chevron, toner supply cartridge, and shroud.
Figure 3:
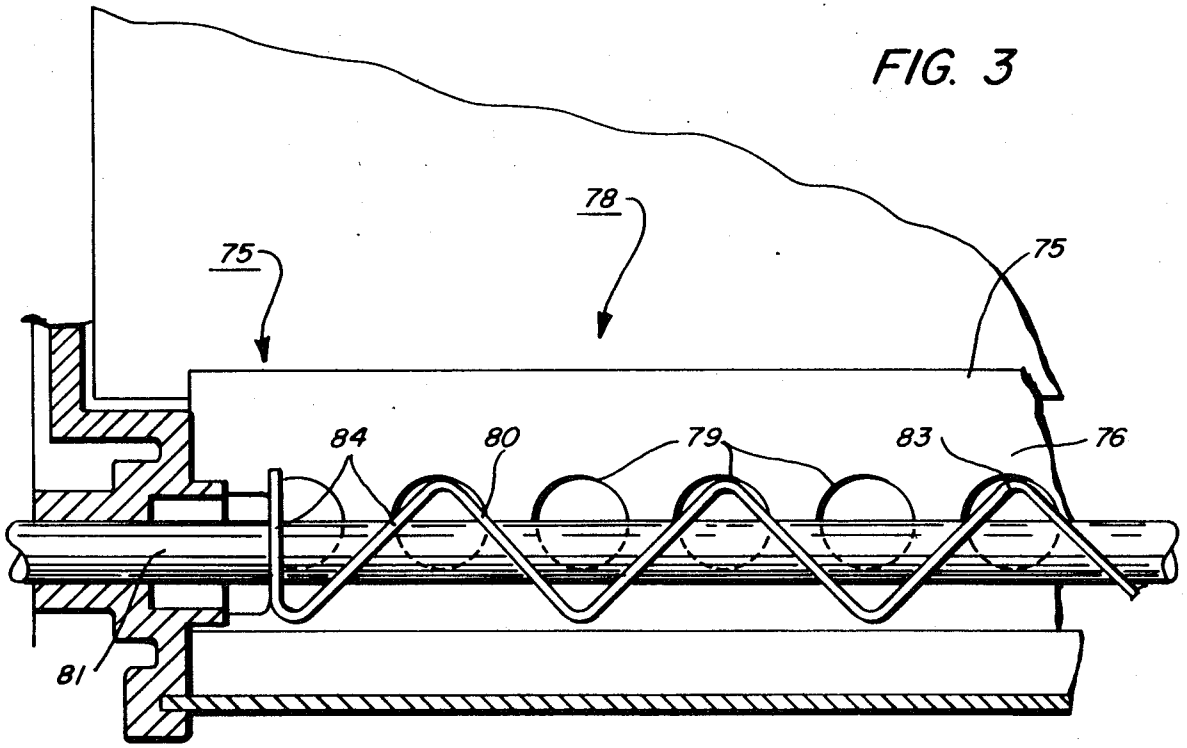
FIG. 3 is a top view showing deatils of the chevron and the relationship thereof to the stripper plate.

Referring particularly to FIGS. 1 and 2, developing station 24 includes a developer housing 65, the lower part of which forms a sump 66 for holding a quantity of developer 67. As will be understood by those skilled in the art, developer 67 comprises a mixture of larger carrier particles and smaller toner or ink particles, commonly referred as two component developer, or a unitary developer mixture commonly refered to as single component developer.

A magnetic brush developer roll 70 is disposed in predetermined operative relation to the photoconductive surface 16 of photoreceptor 14 in developer housing 65, the length of developer roll 70 being equal to or slightly greater than the width of photoconductive surface 16, with the axis of roll 70 paralleling the axis of photoreceptor 14. Developer roll 70 has a relatively stationary magnet assembly 72 disposed within a rotatable cylinder or sleeve 73, sleeve 73 being rotatably journaled for rotation in the opposing sides 68, 69 of developer housing 65. Magnet assembly 72 is arranged so that as sleeve 73 rotates, developer in sump 66 is attracted to the exterior surface of sleeve 73 to form a brush-like covering 74 on sleeve 73. Rotation of sleeve 73 carries the developer brush 74 into developing relation with the photoconductive surface 16 of photoreceptor 14 to develop the latent electrostatic image thereon.

To clean developer from sleeve 73 prior to movement of sleeve through sump 66, an elongated stripper plate 75 is provided in developer housing 65 between sump 66 and the point where developer brush 74 comes into developing relation with the photoconductive surface 16, plate 75 being supported so that the leading edge 76 thereof is in contact with the surface of sleeve 73. Stripper plate 75 is inclined downwardly toward sump 66 so that developer removed from sleeve 73 will gravitate downwardly over the surface 77 of plate 75. To permit the removed developer on the surface 77 of stripper plate 75 to be returned to sump 66, plate 75 has a row 78 of holes 79 therethrough adjacent the lower end of plate 75 which open into sump 66. As a result, developer removed from sleeve 73 by stripper plate 75 moves downwardly along the surface 77 of plate 75 and through holes 79 to sump 66.

Reproduction machine 8 is intended to copy a wide range of document sizes ranging from a relatively small document to a relatively large document. Normally, the document being copied is centered. Since it is expected that the number of small documents that will be copied will exceed the number of larger size documents copied, the amount of toner used will vary across the width of sump 66 with the greatest toner depletion occurring in the center of the sump. To assure a uniform developer mix, proportionally greater amounts of fresh or makeup toner must be added to the center section of the developer housing than at the ends. Further, the fresh toner must be uniformly intermixed with developer removed from sleeve 73 of magnetic brush developing roll 70 by stripper plate 75 if a uniform developer mix across the width of sump 66 is to be maintained.

Referring particularly to FIGS. 2–5, to mix the returning developer and to intermix fresh toner therewith to provide a substantially uniform developer mixture in sump 66, a rotatable chevron 80 is provided. Chevron 80 comprises a rotatable central shaft 81 shaped to provide a succession of blades 80 in the form of a chevron extending along the length thereof. Chevron 80 is fabricated by bending in a generally sinusoidal shape an elongated piece of rigid flat stock having a succession of holes 84 therein, bending being carried out so that holes 84 and suitably attached to the auger blades 83 to form a unitary unit.

Chevron 80 is rotatably supported in sides 68, 69 of developer housing 65 such that the axis of auger 80 is substantially parallel to the axis of magnetic brush developer roll 70 with the axis of chevron 80 being aligned with the row 78 of developer return holes 79 in stripper plate 75. Chevron 80 is driven from magnetic brush roll 70 through gears 71, 82 respectively. Chevron 80 is disposed so that blades 83 are in close predetermined spaced relation with the surface 77 of plate 75 so that as chevron 80 rotates, every other one of the developer return holes 79 are effectively opened and closed with the in-between holes closed and opened. The combined lateral and rotational movement of the chevron blades 83 in effect shifts the developer, and any fresh toner added, back and forth to mix the returning developer removed by stripper plate 75 and intermix in any fresh toner supplied from toner supply cartridge 100. The returned developer along with any fresh toner intermixed therewith passes through holes 79 into sump 66.

A drive motor 87 is provided for operating machine 8, motor 87 being drivingly connected to the machine xerographic components, i.e. photoreceptor 14, fusing roll 49, copy sheet feed roll pair 40, document transport roll pairs 55, 56, and magnetic brush developing roll 70 by suitable coupling means and clutches (not shown).

A suitable controller 89 is provided for operating the various components of machine 8 in predetermined timed relation with one another to produce copies.

Suitable copy sheet and document detectors 90, 92 respectively are provided in the copy sheet path downstream of copy sheet feed roll pair 40 and adjacent the inlet to document transport roll pair 55 to detect the leading edge of a copy sheet 32 and document 9 respectively.

In operation, machine 8 is actuated by a suitable start control button (not shown) to initiate a warm up cycle. During warm up, drive motor 87 is energized to drive photoreceptor 14, sheet feed roll pair 40, fusing roll 49, document transport roll pairs 55, 56, magnetic brush developer roll 70, chevron 80, and toner supply cartridge 100. At the same time, heating lamp 47 is energized to bring fusing roll 49 up to operating temperatures and exposure lamp 58 energized. Following completion of the warm up cycle, the copy sheet 32 is inserted into the nip formed by feed roll pair 40. Roll pair 40 carry the copy sheet forward until the leading edge is detected by detector 90. Controller 89 responds to a signal from detector 90 to stop feed roll pair 40.

The document to be copied is then inserted into the nip of document transport roll pair 55 which carries the document forward across platen 50. As the leading edge of the document reaches detector 92, controller 89, in response to the signal from detector 92, restarts feed roll pair 40 to advance the copy sheet 32 forward in timed relation with the document 9 as the document is transported across platen 50 and past scan point 52 by document transport 54. The document image developed on the photoconductive surface 16 of photoreceptor 14 is tranferred to copy sheet 32 as the copy sheet moves through transfer station 28. Following transfer, the copy sheet 28 passes to fusing station 48 where the image is fixed.

Referring now particularly to FIGS. 1, 2 and 4–7 of the drawings, toner supply cartridge 100 has a hollow tube or cylinder 101, which may for example be formed from any relatively inexpensive light weight material such as cardboard, with a supply of fresh or makeup toner therein. Tube 101 is tightly sealed at both ends 102, 103 by end caps 106, 120 respectively to prevent the escape or leakage of toner. As will appear, tube 101 is supported at the ends 102, 103 for rotation in the opposing sides 68, 69 of developer housing 65 adjacent the top thereof. A plurality of spaced slot-like toner discharge openings or ports 105 are provided in the surface of tube 101, ports 105 being arranged in a linear row. To enhance uniform distribution of makeup toner, ports 105 are preferably of different size with the ports adjacent the tube ends 102, 103 being somewhat smaller in size that the ports adjacent the middle of tube 101.

Figure 4:
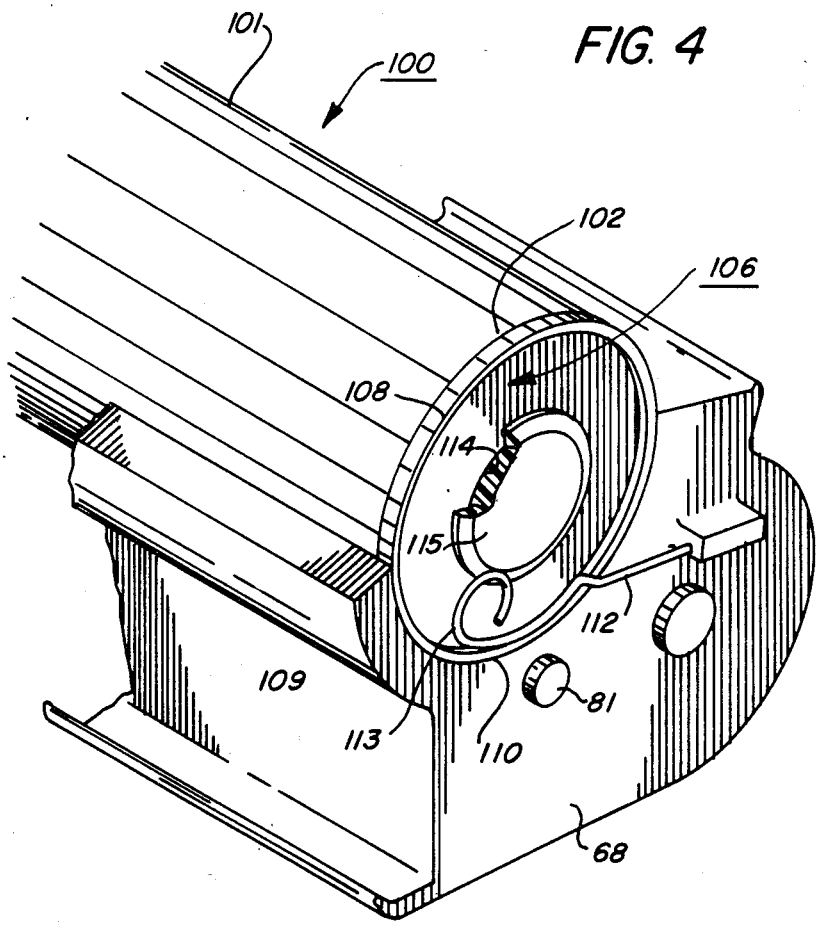
FIG. 4 is an isometric view showing details of the end cap and support for one end of the toner supply cartridge.

Referring particular to FIG. 4, end cap 106 comprises a generally cylindrical part fitted tightly over end 102 of tube 101, cap 106 being recessed slightly to provide an outwardly projecting circular rim 108. A tube end journal 109 with concave interior bearing surface 110 against which the outer periphery or rim of cap 106 rides is provided on side 68 of developer housing 65. To retain end cap 106 in positive engagement with bearing surface 110, a wire-like retaining spring 112 has one end secured to side 68 of housing 65. The opposite end 113 of spring 112 is substantially circular and offset inwardly such that end 113 rides against the recessed surface of rim 108 of cap 106. End cap 106 has a central opening 114 therein to permit toner to be loaded initially into tube 101 of cartridge 100. A suitable plug 115 seals toner loading opening 114 against leakage.

Figure 5:
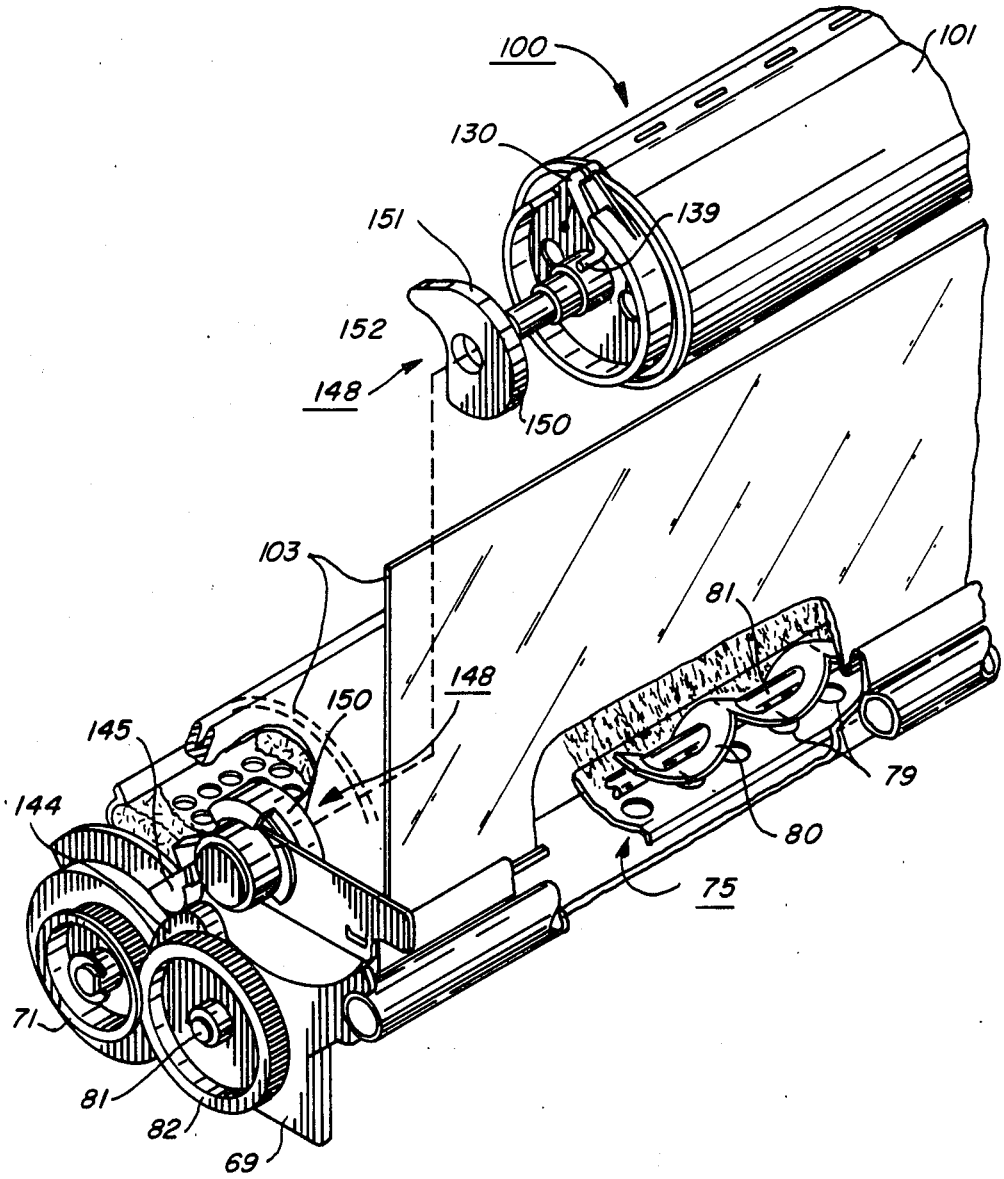
FIG. 5 is an isometric view showing details of the end cap, cartridge drive, and support for the opposite end of the toner supply cartridge.
Figure 6:
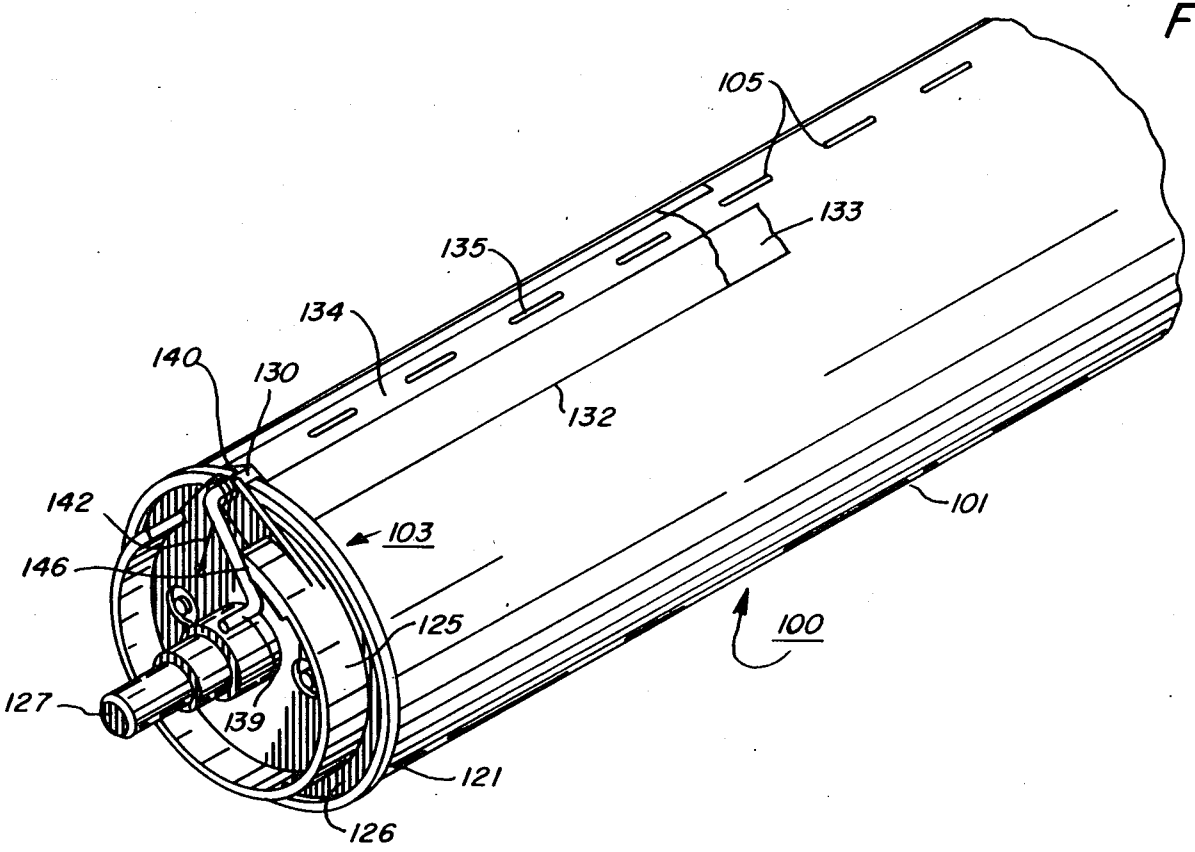
FIG. 6 is an isometric view of the toner supply cartridge for dispensing controlled amounts of fresh toner into the machine developer housing showing details of the toner ejecting rod and the operating mechanism therefor.

Referring particularly to FIGS. 5 and 6, end cap 120 is tightly fitted over the outer edge of tube 101 at the opposite end 103 of tube 101. Cap 120 is recessed slightly into the tube end 103 with an outwardly projecting circular rim 12. A recessed drive hub 125 is attached to cap 120. Hub 125 has a shaft 127 projecting axially therefrom for use in mounting and driving tube 101.

Figure 7:
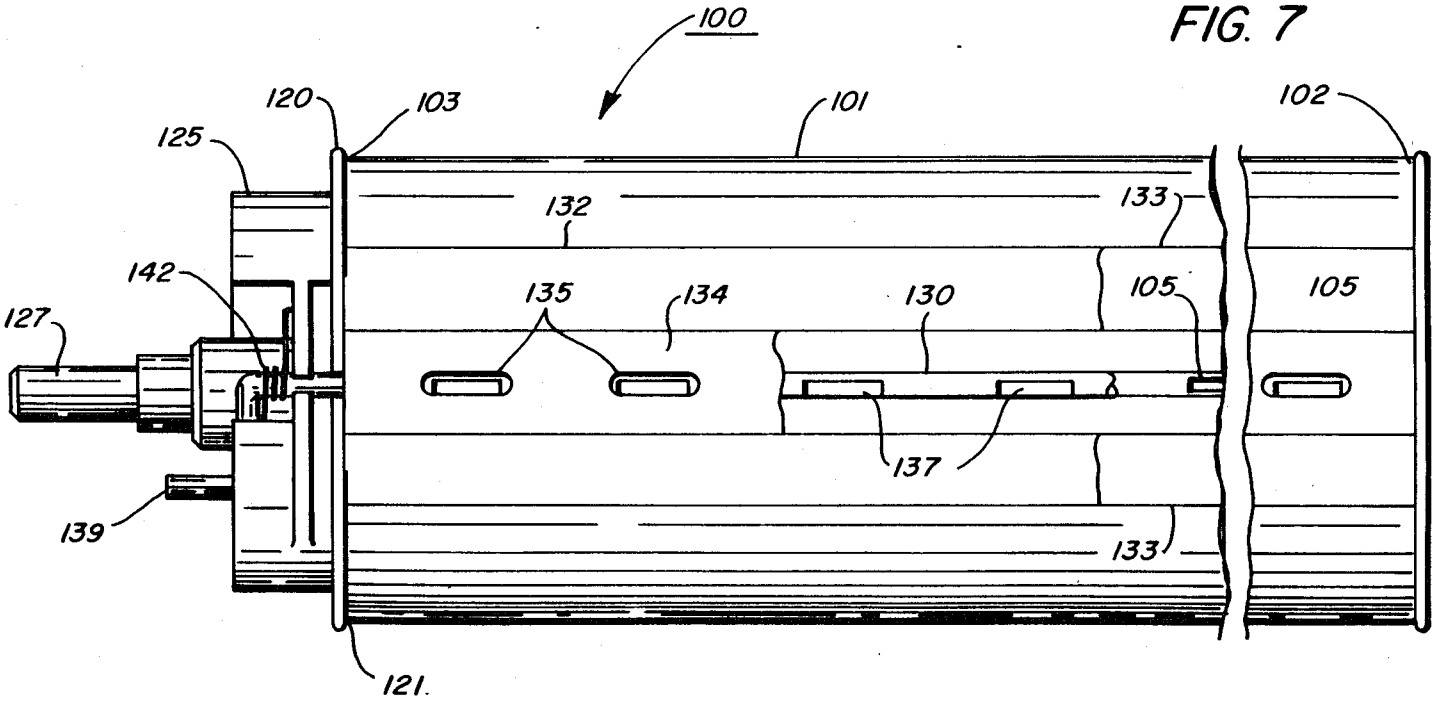
FIG. 7 is a top view of the toner supply cartridge shown in FIG. 6.

Referring particularly to FIGS. 5–7, to control the timing and quantity of toner discharged from ports 105 of tube 101, an elongated toner dumping or ejecting rod 130 is provided. Rod 130 extends the length of tube 101 opposite the row of toner discharge openings 105 and is held in tight contact with the outer surface of tube 101 opposite openings 105 by a strip of adhesive backed tape 132. The diameter (d) of rod 130 is slightly larger than the width (w) of the toner discharge ports 105 in tube 101 to assure closing of ports 105 by rod 130.

To hold rod 130 in position opposite toner discharge openings 105 while allowing rod 130 to rotate, a non-adhesive tape 132 is used, tape 132 being attached to the exterior of tube 101 over rod 130 by means of a pair of holddown tapes 133 running along each side of the row of toner discharge openings 105. This provides tape 132 with what in effect is a non-adhesive segment 134 along the central portion of tape 132 opposite rod 130. A row of toner discharge slots 135 are provided in toner discharge ports 105 in tube 101. The size and shape of slots 135 are preferably the same as that of toner discharge ports 105. Holddown tapes 133 each comprise a strip of double sided tape, that is, tape having an adhesive on both sides. As a result, tapes 133 adhere to both the exterior of tube 101 and the inside of tape 132 to fasten tape 132 tightly and securely to tube 101 of canister 100.

Rod 130 has a series of recesses or flats 137 formed therein, there being one flat 137 opposite each toner discharge port 105 in tube 101. To control the amount of toner discharged, the size of flats 137 is varied with flats near the opposite ends of tube 101 being somewhat shallower than the flats adjacent the middle of tube 101. As will be understood, the effective size of flats 137 is changed by changing the depth to which the flats 137 are cut so that where it is desired to eject lesser quantities of fresh toner (i.e. adjacent the ends of tube 101), the depth of the flats in that area ia made less than the depth of the flats adjacent the middle of tube 101.

The end 139 of rod 130 adjacent tube end 130 is extended and formed with an inwardly projecting offset or dogleg. An extrusion 140 is mounted on the periphery of hub 125 and has an inward facing semicircular recess or cutout 141 which cooperates with hub 125 to form a journal for rotatably supporting rod 130 in position on the periphery of tube 101.

Referring particularly to FIGS. 5 and 6, tube 101 is rotated in predetermined timed relation with magnetic brush sleeve 73 and auger 80 by cam and follower 144, 145 respectively. Cam 144 is drivingly coupled to and rotates with shaft 81 of auger 80. Cam follower 145 is drivingly coupled to shaft 127 of drive hub 125. A spring member 142 is wound about end 139 of rod 130, with the opposite spring ends being trapped between end 139 of rod 130 and hub 125. Spring 142 biases end 139 of rod 130 against a stop surface 146 on hub 125. In this position, flats 137 on rod 130 face outwardly from tube 101 in a toner discharge or ejecting position.

To operate toner ejecting rod 130 in timed relation with the rotation of tube 101 of cartridge 100 so as to discharge or eject a charge of fresh toner into developer housing 65 each time toner discharge ports 105 are in a position where the ports 105 face into developer housing 65, a cam 148 is provided. Cam 148, which is rotatably mounted on hub 125, is operated by cam follower 145 as follower 145 rotates tube 101 of cartridge 100. End 139 of rod 130 is offset sufficiently so that end 139 lies in the path of travel of the cam surface 150 on cam 148. Thus, as cam 148 rotates, end 139 rides onto the cam surface 150, which has a curved segment 151 with a relatively deep recess or well 152 therein. As will appear, well 152 serves to rapidly rotate toner ejecting rod 130 at the proper moment in the cycle as end 139 of rod 120, which is spring loaded, falls off cam segment 151 and into well 152. The resulting rapid movement of rod 130 in effect ejects or throws toner resting on flats 137 of rod 130 into developer housing 65.

In operation, tube 101 of cartridge 100 is rotated by cam and follower 144, 145 respectively. This brings the offset end 139 of rod 130 into engagement with the edge of well 152 of cam surface 150. As end 139 of rod 130 rides up the side of well 152, rod 130 is quickly rotated against the bias imposed by spring 142 to turn flats 137 so that flats 137 face the interior of tube 101. Following well 152, the offset end 139 of rod 130 rides along the curved segment 151 of cam surface 150 to maintain flats facing inwardly as tube 101 rotates around and toner discharge ports 105 are moved first upwardly along an arcuate path to the topmost point of travel and then downwardly along an arcuate path into developer housing 65. As toner discharge ports 105 approach a preset point within developer housing 65, the offset end 139 of rod 130 rides down the side of well 152 of cam surface 150. This results in rod 130 being rapidly rotated which in turn causes flats 137 on ejecting rod 130 to be quickly moved or snapped from a position where flats 137 face inwardly toward the interior of tube 101 to a position where flats 137 face outwardly toward the interior of developer housing 65. As a result, the toner deposited on flats 137 of toner ejecting rod 130 during the rotational cycle of tube 101 of cartridge 100 is thrown or ejected into developer housing 65.

Figure 8:
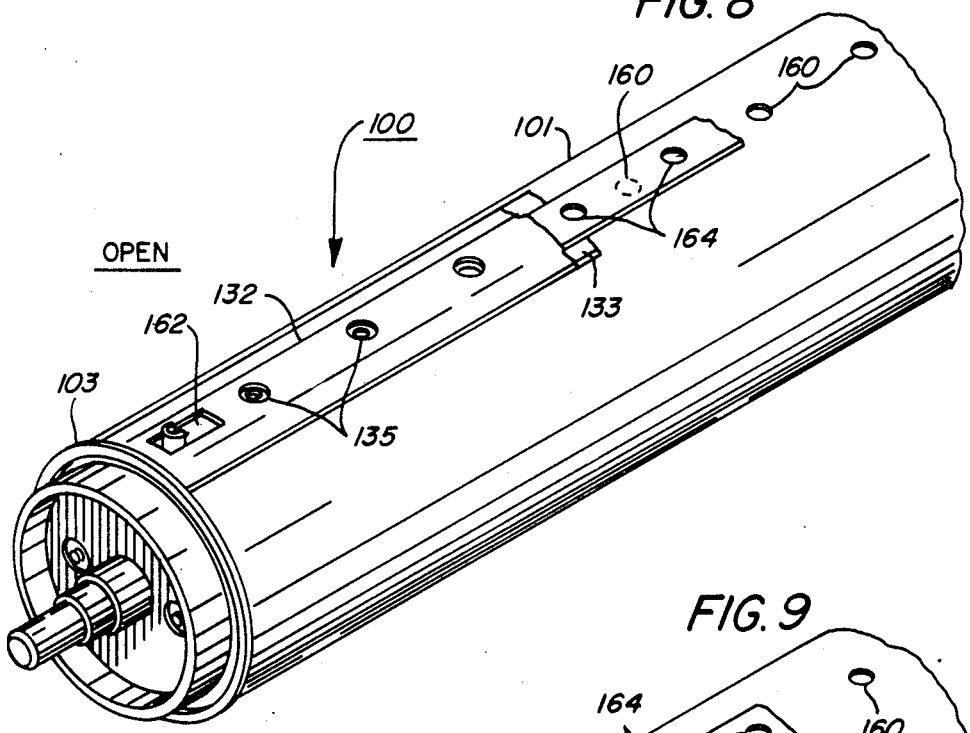
FIG. 8 is an isometric view of a toner supply cartridge in which the toner ejecting rod is replaced by a reciprocable slide plate for dispensing controlled amounts of toner into the machine developer housing, the slide plate being in a closed position.
Figure 9:
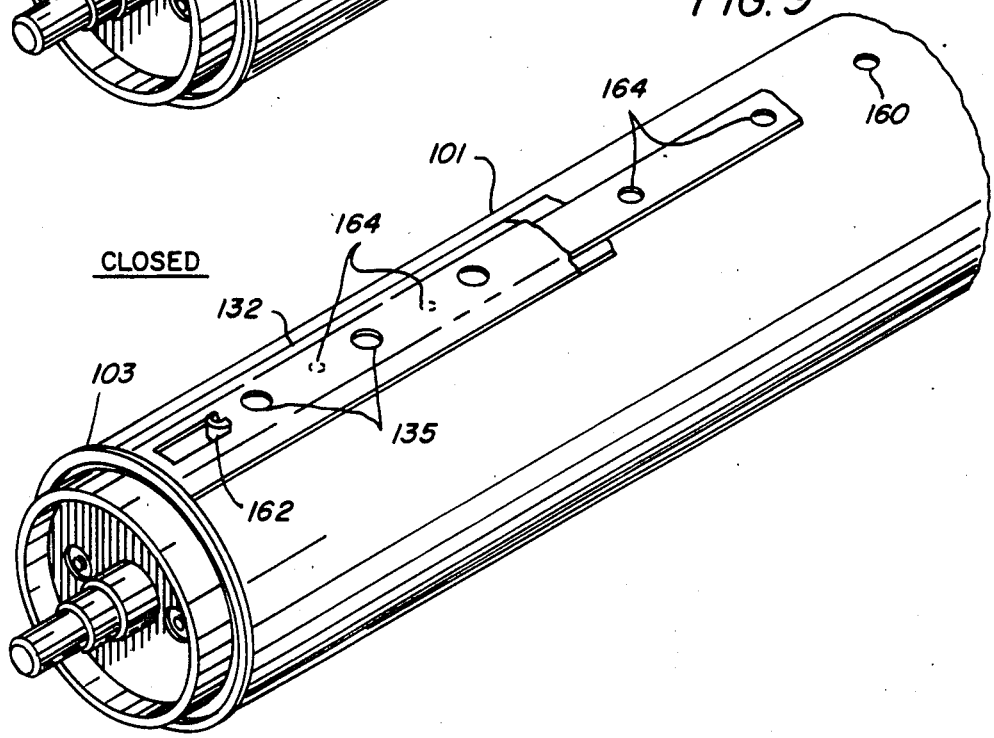
FIG. 9 is an isometric view with the cartridge in an open position.
Figure 10:
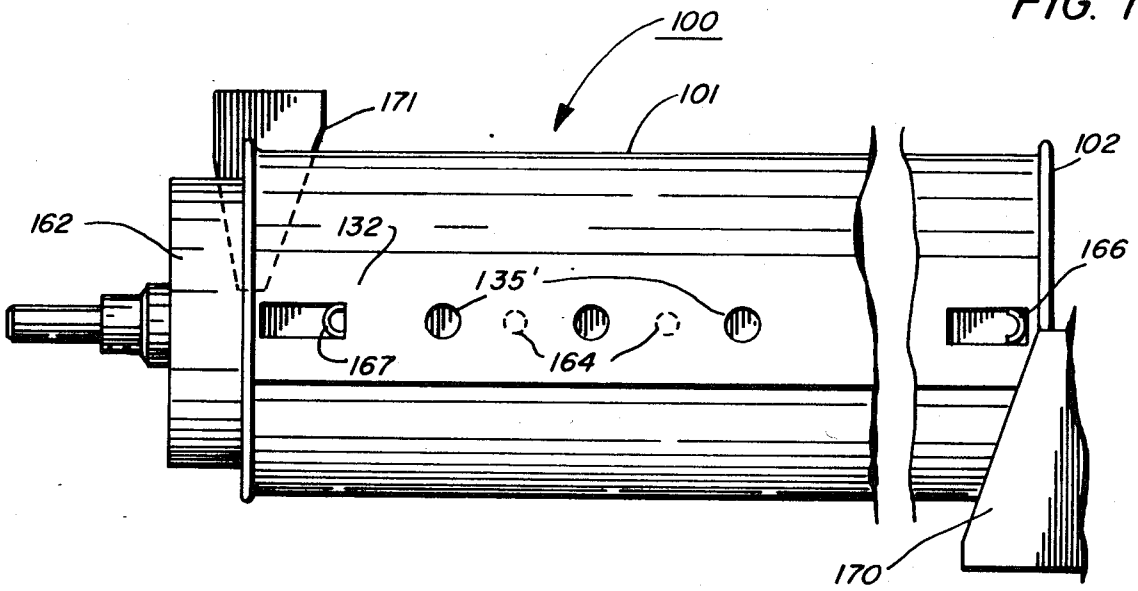
FIG. 10 is a top view of the toner dispensing cartridge shown in FIGS. 8 and 9 showing details of the cam drive for opening and closing the slide plate.

In the embodiment shown in FIGS. 8–10, where like numerals refer to like parts, the slot-like toner discharge ports 105 of tube 101 of cartridge 100 are replaced by a row of generally circular toner discharge openings or ports 160. To provide for a substantially uniform developer mix across the width of sump 66, ports 160 are of varying size, the ports adjacent the ends 102, 103 of tube 101 being smaller in size than those in the center of tube 101. An elongated rigid strip-like slide plate 162 controls opening and closing of toner discharge ports 160, plate 162 being held in tight face to face contact with the outer surface of tube 101 opposite ports 160 by tape 132 to seal tube 101 against the leakage or loss of toner when plate 162 is in the closed position. Tape 132 is assembled with and held in position on the exterior of tube 101 by double side holddown tapes 133 in the manner described before. Plate 162, which is supported for reciprocating back and forth sliding movement along the outer surface of tube 101, has a series of toner discharge openings 164 therein which mate with ports 160 in tube 101 and openings 135' in tape 132 when slide plate 162 is moved to the open position. Toner discharge ports 160 and openings 164 and 135' in plate 162 and tape 132 respectively are of substantially the same size and shape.

To operate slide plate 162, plate 162 has a pair of radially outwardly projecting followers 166, 167 adjacent each end. Plate opening and closing cams 170, 171 respectively are provided on sides 68, 69 of developer housing 65 with the cam surfaces thereof in the path of movement of followers 166, 167. Cams 170, 171 are angularly separated from one another by a predetermined number of degrees to provide a preset duration during which slide plate 162 is moved to the open position to allow toner to be dispensed from tube 101.

In operation, as tube 101 of cartridge 100 rotates and toner discharge ports 160 approach a position in which the ports 160 face toward the interior of developer housing 65, follower 166 on plate 162 rides against the surface of cam 170. The interengagement of follower 166 with cam 170 drives or slides plate 162 sideways through a preset stroke to align the toner discharge openings 164 in plate 162 with toner discharge ports 160 in tube 101 and openings 135' in tape 132. This allows fresh toner to fall from tube 101 through the matching ports 160 and openings 164, 135' into developer housing 65 for a predetermined duration determined by the degree of angular offset between cams 170, 171. The continued rotation of tube 101 brings follower 167 on plate 162 into engagement with the surface of cam 171 to drive or slide plate 162 in the opposite direction. This moves the toner discharge openings 164 in plate 162 out of alignment with ports 160 and openings 135', effectively closing ports 160 and terminating the dispensing of fresh toner from tube 101 of cartridge 100.

Referring particularly to FIGS. 2 and 5, to close off the generally rectangular area between photoreceptor 14 and toner cartridge 100, yet permit pressure that develops within housing 65 during operation of machine 8 to be relieved, a removable cover or shroud 210 is provided. Shroud 210 is generally rectangular in shape and has, when viewed in cross section a generally U-shape with upstanding sides 211, 212. To prevent or at least inhibit material such as toner dust, dirt, etc. from passing between the surface 16 of photoreceptor 14 and side 211 of shroud 210, side 211 is spaced closely adjacent the surface 16 of photoreceptor 14. For this purpose, side 211 is curved with a radius of curvature substantially the same as the radius of curvature of surface 16. Side 212 of shroud 210 engages and interlocks with a removable cover 213 encasing the upper part of cartridge 100, cover 213 extending from the side 212 of shroud 210 to the outside wall of developer housing 65. Side 212 of shroud 210 and cover 213 are curved with a radius of curvature substantially the same as the radius of curvature of cartridge 100.

Shroud 210 is preferably a throw-away part, and as such is made of any suitable inexpensive material, such as cardboard, which has the necessary combination of flexibility and rigidity to enable shroud 210 to be formed or snapped into position between sides 68, 69 of developer housing 65. The width of shroud 210 between sides 211, 212 thereof is slightly less than the distance between photoreceptor 14 and cartridge 10 to provide a minimum operating space between side 211 of shroud 210 and the surface of photoreceptor 14 while the length of shroud 210 is slightly greater than the distance between sides 68, 69 of housing 65 to provide the necessary force to maintain shroud 210 in position.

Shroud 210 has plural rows of pressure relief ports 215 extending across the length thereof. Ports 215 may be of any suitable shape such as circular. To prevent dust, toner particles, and other debris from escaping through pressure relief ports 215 into the adjoining areas of machine 8, a filter 226, which is composed of any suitable relatively hard or rigid filter media, is placed on the upper surface of shroud 210 over ports 215. The width of filter 226 is somewhat greater than the space separating sides 211, 212 of shroud 210 so that filter 226, when mounted on the surface of shroud 210, is compressed slightly and trapped between sides 211, 212 to retain filter 226 in place. The length of filter 228 is substantially equal to the length of shroud 210 so that filter 228 covers the entire surface of shroud 210 and ports 215 therein.

During operation of machine 8, shroud 210 effectively seals the space between the side 212 of shroud 210 and the exterior of cartridge 100, with filter 226 trapping any dust, toner particles, etc. that are entrained with pressure air being exhausted from developer housing 65 through ports 215.

While the invention has been described with reference to the structure disclsoed, it is not confined to the details set forth, but is intended to cover such modifications or changes as may come within the scope of the following claims.

I claim:

1. In a copying/printing machine having a movable recording member on which a latent electrostatic images are created, developing means for developing said images with toner, and transfer means for transferring the developed images to a copy substrate material, said developing means including a developer housing adjacent said recording member with means in said housing to bring developer from said housing into developing relation with said recording member to develop images on said recording member, the combination of:

(a) a tube-like cylinder adapted to contain a supply of fresh toner;

(b) means supporting said cylinder in spaced relation above said sump, the axis of said cylinder being substantially parallel with the longitudinal axis of said developer housing;

(c) drive means for rotating said cylinder to maintain the toner in said cylinder fluffed to enhance discharge;

(d) said cylinder having a plurality of toner discharge openings therein for toner to pass from said cylinder into said developer housing, said toner discharge openings comprising a row of openings extending along the longitudinal axis of said cylinder with said toner discharge openings sized differently from one another to regulate the quantity of toner discharged into said developer housing in accordance with machine operating conditions; and (e) control means for discharging controlled amounts of fresh toner through said toner discharge openings in timed sychronization with the rotation of said cylinder, said control means discharging said toner while said toner discharge openings are facing said developer housing so that toner is carried by gravity into said developer housing.

2. The machine according to claim 1 which said control means includes (a) a strip-like closure in sealing engagement with the periphery of said cylinder opposite said row of toner discharge openings, (b) means supporting said strip-like closure for reciprocable sliding movement on said cylinder between first and second positions;

(c) said strip having an aperture therein for each of said toner discharge openings, movement of said strip to said first position bringing said apertures into communicating relation with the associated toner discharge opening so that toner can discharge from said cylinder to said developer housing, said strip when moved to said second position interrupting communication between said toner discharge openings and said apertures whereby to close said toner discharge openings.

3. The machine according to claim 1 in which said control means comprises a rotatable member.

4. The machine according to claim 3 in which said rotatable member comprises (a) a rod in sealing engagement with the periphery of said cylinder opposite said row of toner discharge openings, (b) the diameter of said rod being such that said rod closes said toner discharge openings;

(c) a portion of the circumference of said rod opposite each of said toner discharge openings being removed to provide a toner supporting surface on said rod at each of said toner discharge openings, (d) said toner supporting surfaces facing toward the interior of said cylinder when said rod is rotated to a first toner opening closing position, (e) said toner supporting surfaces facing outwardly when said rod is rotated to a second toner opening closing position whereby controlled amounts of toner resting on said toner supporting surfaces are discharged into said housing when said rod is rotated to said second position.

5. A toner cartridge comprising:

(a) a tube-like cylinder adapted to contain a supply of toner;

(b) said cylinder having a series of toner discharge ports therein for the discharge of toner from said cylinder, said toner discharge ports extending longitudinally along said cylinder;

(c) a longitudinally extending plate on the periphery of said cylinder opposite said toner discharge ports; and (d) means supporting said plate for reciprocating sliding movement on said cylinder;

(e) said plate having toner discharge openings therein cooperable with said toner discharge ports in said cylinder to control discharge of toner from said cylinder through said toner discharge ports, movement of said plate to one position bringing said toner discharge openings in said plate into communicating relation with said toner discharge ports in said cylinder so that toner can discharge from said cylinder through said toner discharge ports in said cylinder, said plate when moved to a different position interrupting communication between said toner discharge ports in said cylinder and said toner discharge openings in said plate.

6. The cartridge according to claim 5 in which said supporting means includes longitudinally extending strip means overlaying said plate and retaining said plate on said cylinder, said plate being movable relative to said strip means, and adhesive means for attaching said strip means to said cylinder whereby said plate is retained on said cylinder for said reciprocating sliding movement.

7. The cartridge according to claim 6 including plural toner discharge openings in said strip means allowing discharge of toner from said toner discharge openings in said plate.

8. The cartridge according to claim 7 in which said adhesive means comprises a pair of strip-like adhesive elements on each side of said plate between said cylinder and said strip means, said elements having adhesive on the surface thereof between said element and said cylinder and between said element and said strip means whereby to adhere said strip means to said cylinder and retain said plate on said cylinder.

9. A dispensing cartridge for developing material in a copying/printing machine comprising:

(a) a tube-like cylinder adapted to contain a supply of said developing material;

(b) said cylinder having plural ports therein for the discharge of said developing material from said cylinder, said ports extending longitudinally along said cylinder;

(c) a longitudinally extending plate on the periphery of said cylinder, said plate being capable of reciprocating movement along said cylinder and having plural openings therein for the discharge of said developing material on alignment of said openings with said ports in said cylinder, said plate closing said ports in said cylinder on movement of said plate to a position where said openings in said plate and said ports in said cylinder are not aligned;

(e) a retaining strip overlaying said plate, said strip having plural openings for discharge of developing material on movement of said plate to a position where said openings in said plate are aligned with said openings in said strip; and (f) means to attach said strip to said cylinder to retain said plate on said cylinder while allowing said reciprocating movement of said plate.

10. A toner cartridge comprising:

(a) a tube-like cylinder adapted to contain a supply of fresh toner;

(b) said cylinder having a longitudinally extending row of toner discharge ports therein for the discharge of toner from said cylinder;

(c) a longitudinally extending rod in sealing engagement with the periphery of said cylinder opposite said row of toner discharge ports, (d) the diameter of said rod being such that said rod closes said toner discharge ports;

(e) a portion of the circumference of said rod opposite each of said toner discharge ports being removed to provide a toner supporting surface on said rod at each of said toner discharge ports on which toner can accumulate when said toner supporting surfaces face toward the interior of said cylinder; and (f) means supporting said rod on said cylinder for rotation whereby to allow said rod to be rotated so that said toner supporting surfaces face away from the interior of said cylinder and permitting toner accumulated on said rod supporting surfaces to be discharged.

11. The toner cartridge according to claim 10 in which said supporting means includes longitudinally extending strip means overlaying said rod and retaining said rod on said cylinder, said rod being movable relative to said strip means, and adhesive means for attaching said strip means to said cylinder to retain said rod on said cylinder while permitting said rod to rotate.

12. The cartridge according to claim 11 including a plural toner discharge openings in said strip means opposite each of said toner discharge ports in said cylinder allowing toner accumulated on said toner supporting surfaces to be discharged through said openings in said strip means when said rod is rotated so that said toner supporting surfaces face away from the interior of said cylinder.

13. The cartridge according to claim 12 in which said adhesive means comprises a pair of strip-like adhesive elements on each side of said plate between said cylinder and said strip means, said elements having adhesive on the surface thereof between said element and said cylinder to attach said elements to said cylinder and having adhesive on the surface thereof between said elements and said strip means to attach said strip means to said cylinder and retain said rod on said cylinder.

* * * * *